US006095334A

United States Patent [19]

Belveal et al.

[11] Patent Number: 6,095,334

[45] Date of Patent: Aug. 1, 2000

[54] MIRROR COMPACT CASE

[76] Inventors: Ramona M. Belveal, 222 S. Pearl, Centralia, Wash. 98531; Joyce L. Beilby, 4131 Bear River Dr., Rio Oso, Calif. 95674

[21] Appl. No.: 09/205,431

[22] Filed: Dec. 4, 1998

Related U.S. Application Data

[60] Provisional application No. 60/067,849, Dec. 5, 1997.

[51] Int. Cl.[7] ..... B65D 69/00

[52] U.S. Cl. ..... 206/581; 206/823; 132/316

[58] Field of Search ..... 206/581; 208/38, 208/37, 823; 132/316

[56] References Cited

U.S. PATENT DOCUMENTS

| | | | |
|---|---|---|---|
| 1,229,285 | 6/1917 | Kendall . | |
| 1,512,005 | 10/1924 | Wright . | |
| 1,525,665 | 2/1925 | Slover et al. . | |
| 1,989,155 | 1/1935 | Rosenberg | 132/83 |
| 2,421,646 | 6/1947 | Pepin | 132/83 |
| 3,949,767 | 4/1976 | Rose | 132/83 |
| 3,996,947 | 12/1976 | Szpur et al. | 132/79 |
| 5,611,362 | 3/1997 | Duncan et al. | 132/301 |

*Primary Examiner*—Jacob K. Ackun
*Attorney, Agent, or Firm*—Dean A. Craine

[57] ABSTRACT

A dual-face mirror compact case which, in the closed position, is sufficiently small to be carried in a purse, pocket and the like. Disposed longitudinally inside the case is an extendable and retractable yoke with a pivoting, dual-faced mirror assembly attached at its distal end. The mirror assembly is pivotally attached to the yoke so that it may pivot on its transverse axis, allowing the user to easily choose a normal reflective surface or a magnifying reflective surface. A press button is attached to the housing which, when activated, enables the yoke and mirror assembly to automatically extend from the housing via a spring located inside the housing. When the user is done using the mirror surfaces, the mirror assembly is pivoted into a longitudinally aligned position on the yoke and the yoke is forced into a locked, retracted position inside the housing. An optional light is provided on the housing, which can be used to illuminate the used mirror surface and the reflected viewed surface. In another embodiment, the compact case is a clam shell design with two lids that pivot around the mirror assembly.

5 Claims, 4 Drawing Sheets

MIRROR COMPACT CASE

This is a utility patent application based on a provisional patent application filed on Dec. 5, 1997 (Ser. No. 60/067,849).

BACKGROUND OF THE INVENTION

1. Field of the Invention

This invention relates to a personal hygiene kit, and more particularly, to a personal hygiene case with a regular mirror and a magnifying mirror mounted therein to assist normal and visually-impaired individuals.

2. Description of the Related Art

For many years, cosmetic compact cases with mirrors mounted therein have been used to assist individuals in the application of cosmetics. Such cases are sufficiently small to be transported via a handbag, pocket or such. Typically, the compact cases include a flat mirror positioned on the inside surface of the lid which pivots into an opened position 180 degrees on the base section. The compact case is held or placed on a rigid surface to apply cosmetics, comb hair, or insert and remove contact lenses.

It is commonly known that one's vision becomes impaired with age and with certain diseases, such as diabetes. Visual impairment is especially troublesome for women who desire to wear cosmetics and for individuals who wear contact lenses. One solution would be to replace the flat mirror commonly found in a compact case with a convex or magnifying mirror. The main drawback with this proposition is that a magnifying mirror does not provide a sufficiently wide viewing field for viewing one's overall appearance or for combing hair.

What is needed is a small, portable compact case containing a mirror with both normal and magnifying reflective surfaces. Such a case should house the mirror in a protective manner, yet allow it to be selectively removed from the case and adjusted for optimal viewing when the case is either hand-held or independently supported on a rigid surface. Such a case should also include a light which illuminates the mirror and the viewed image.

SUMMARY OF THE INVENTION

It is an object of the present invention to provide a compact case that houses a mirror having normal and magnifying reflecting surfaces.

It is another object of the present invention to provide such a compact case which protects the mirror yet allows the reflective surfaces to be selectively adjusted in position relative to the case for optimal viewing when the case is either hand-held or independently supported on a rigid surface.

It is yet another object of the present invention to provide such a compact case with a light capable of illuminating the reflective surfaces and the viewed image during use.

These and other objects of the invention are met by the invention disclosed herein which describes a compact case which, in the closed position, is sufficiently small enough to be carried in a purse, pocket and the like. Disposed inside the case's housing is a yoke with a rotating, dual-faced mirror assembly attached thereto. The mirror assembly has a flat or normal reflective surface on one side and a convex or magnifying reflective surface on the opposite side. The mirror assembly is rotatably mounted at two points on its outer diameter between the two arms of the yoke. During use, the mirror assembly is able to rotate 360 degrees thereby enabling the user to select either reflective surface and to selectively adjust the position of the mirror assembly for optimal viewing.

In one embodiment, the housing is a relatively thin and rectangular shape with an opening formed at one end and a longitudinally aligned cavity formed therein. The cavity is sufficiently large to contain both the yoke and mirror assembly. During assembly, the yoke is disposed inside the cavity and designed to move longitudinally therein. A release means is provided on the side of the housing which the user selectively activates to extend the yoke from the housing.

In a second embodiment, the yoke is rotatably mounted on a hinge assembly with two lids pivotally connected together to the hinge assembly. During use, the lids are rotated thereby exposing the mirror assembly. The yoke may rotate 360° along its vertical axis and the mirror may rotate 360° along its horizontal axis for optimal viewing.

In one embodiment, an optional light means is provided which illuminates both the mirror assembly and the surface viewed by the reflective surface. The light means is connected to a switch means and a battery located inside the housing.

DESCRIPTION OF THE PREFERRED EMBODIMENT(S)

Figure 1:
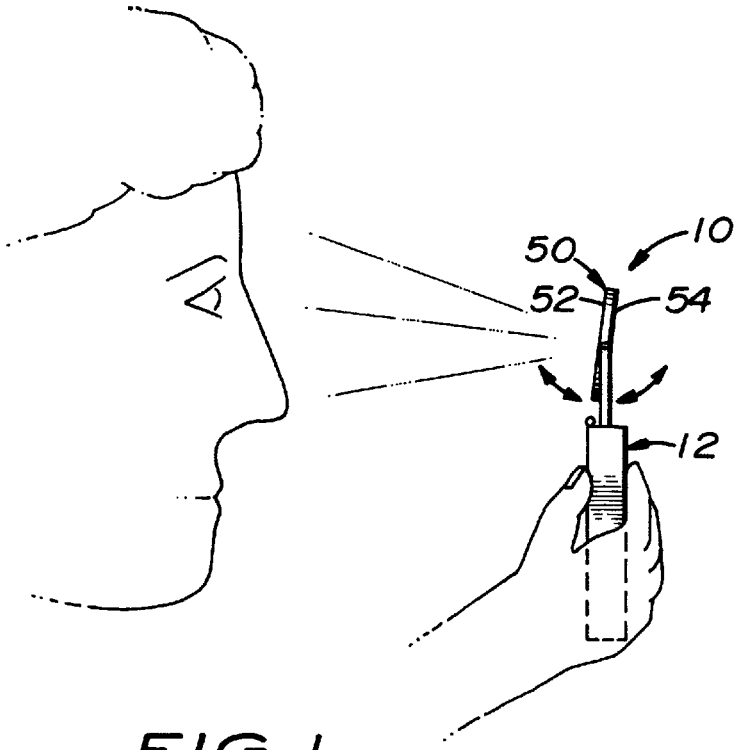
FIG. 1 is a side view of an individual using the compact case in an open extended position with the mirror assembly rotated to view images on the flat mirror surface.
Figure 2:
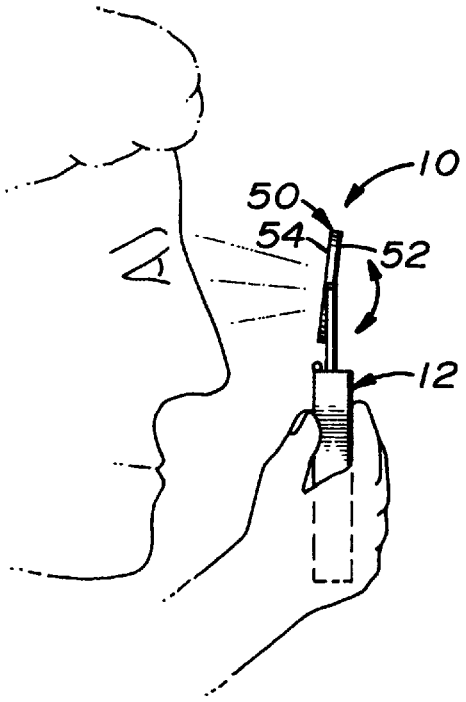
FIG. 2 is a side view of an individual using the compact case in an open extended position with the mirror assembly rotated to view images on the magnifying mirror surface.

Wherein like reference numbers refer to like parts, a first embodiment of a compact case 10 is shown in FIGS. 1–6 comprising a housing 12 with a yoke 40 and a pivoting mirror assembly 50.

The housing 12 is a thin, rectangular-shape enclosure with a front surface 14, back surface 15, right side surface 16, left side surface 17, top surface 18, and bottom surface 19. The housing 12 is manufactured by attaching together matching top and bottom sections 36, 37 each made of plastic material.

The mirror assembly 50 includes a magnifying reflective surface 52 and a normal reflective surface 54. While in the preferred embodiment the mirror assembly 50 is circular and approximately 2 inches in diameter, it should be understood that the mirror assembly 50 is not limited to any particular size or shape. Also, the magnifying reflective surface 52 has a power of at least 1.5, however other powers may be used.

Figure 6:
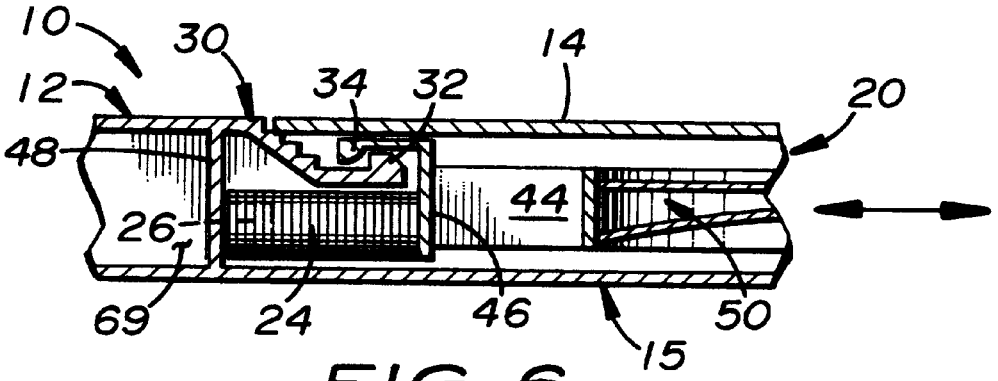
FIG. 6 is a partial, sectional view of the compact case showing the sliding yoke in a locked, retracted position inside the housing.

The yoke 40 is designed to slide longitudinally from the housing 12 through an opening 22 formed on the top surface 18. The yoke 40 includes a right arm 42 and the left arm 44 spaced apart and aligned in a parallel position. A cross member 46 is transversely aligned and attached between the proximal ends of the arms 42, 44. As shown in FIG. 6, formed on the lower surface of the cross member 46 is a catch 34 which is engaged by the latch 32 formed on the housing 12 to hold the yoke 40 inside the housing 12. A longitudinally aligned main spring 24 is disposed inside the housing 12 which is used to force the yoke 40 into an extending position. The distal end of the main spring 24 is attached to a seat 26 located on the transversely aligned cross member 48 located adjacent to the battery compartment 69 inside the housing 12.

A release means comprising a press button 30 is located on the top surface 14 of the housing 12, which is used to release the yoke 40. The press button 30 is integrally formed with the latch 32, which is forced downward to disengage the catch 34 on the cross member 46 when the press button 30 is pressed inward by the user. When the press button 30 is activated by the user, the yoke 40 is automatically forced through the opening 22 to an extended position from the housing 12. To retract the yoke 40 into the housing 12, the mirror assembly 50 is positioned in an aligned position with the longitudinal axis of the yoke 40 and forced inward until the latch 32 engages the catch 34.

Figure 3:
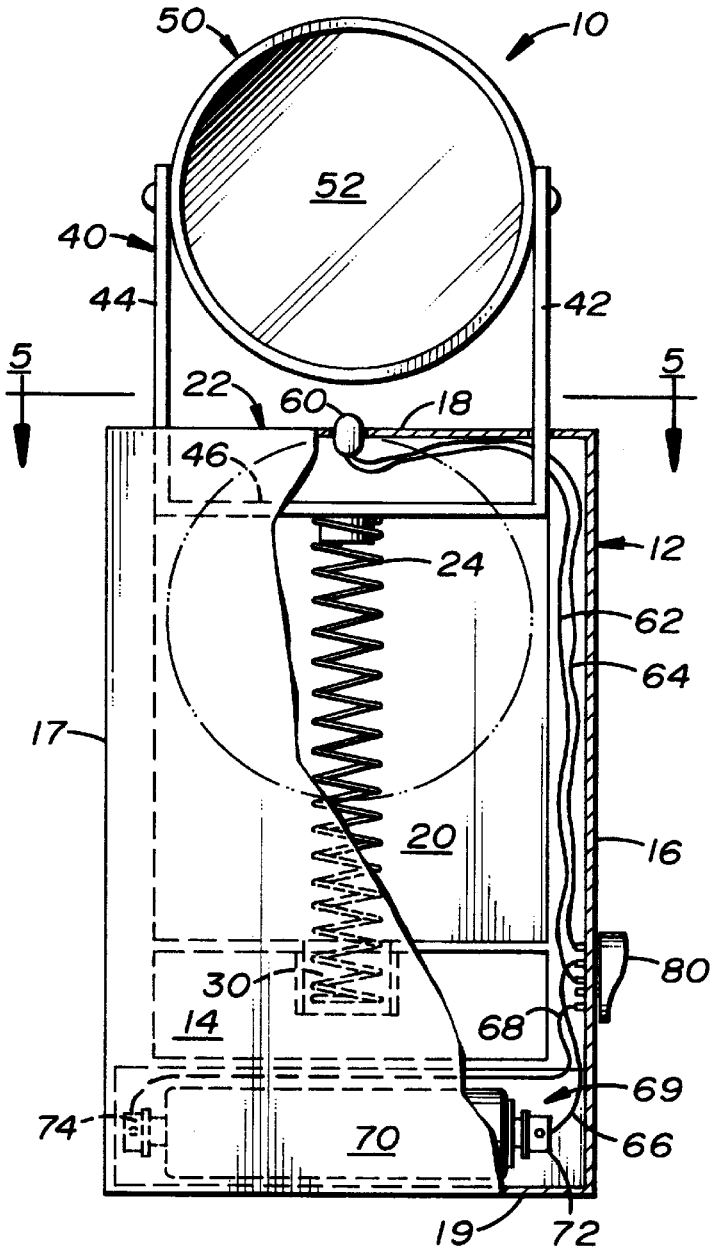
FIG. 3 is a top plan view, partially in section, of the compact case showing the sliding yoke in an extended and retracted position inside the housing.
Figure 4:
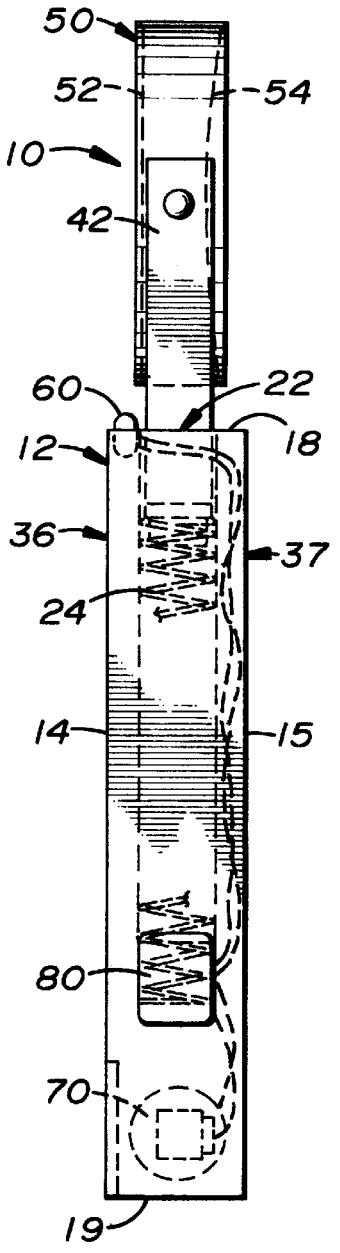
FIG. 4 is a side elevational view of the compact case shown in FIG. 3.
Figure 5:
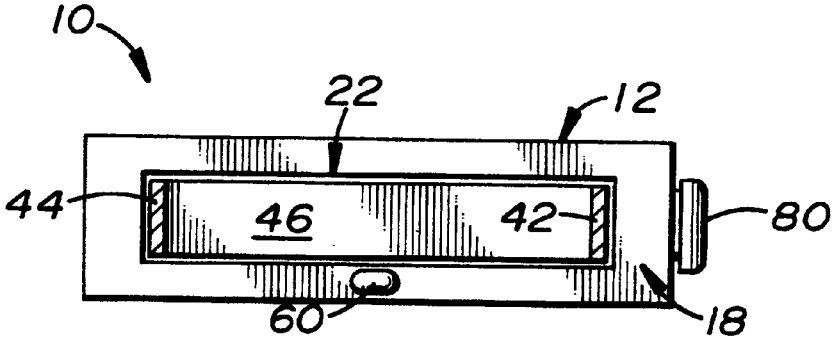
FIG. 5. is a sectional, elevational view of the compact case taken along line 5—5 in FIG. 4.

As shown in FIG. 3, an optional on/off switch 80 is attached to the housing 12, which controls an optional light 60 located on the top surface 18. The light 60 is connected to wires 62, 64, which are connected to terminals on the switch 80. Wires 66, 68 connect the switch 80 to a battery 70 located inside the battery compartment 69 in the housing 12.

Figure 7:
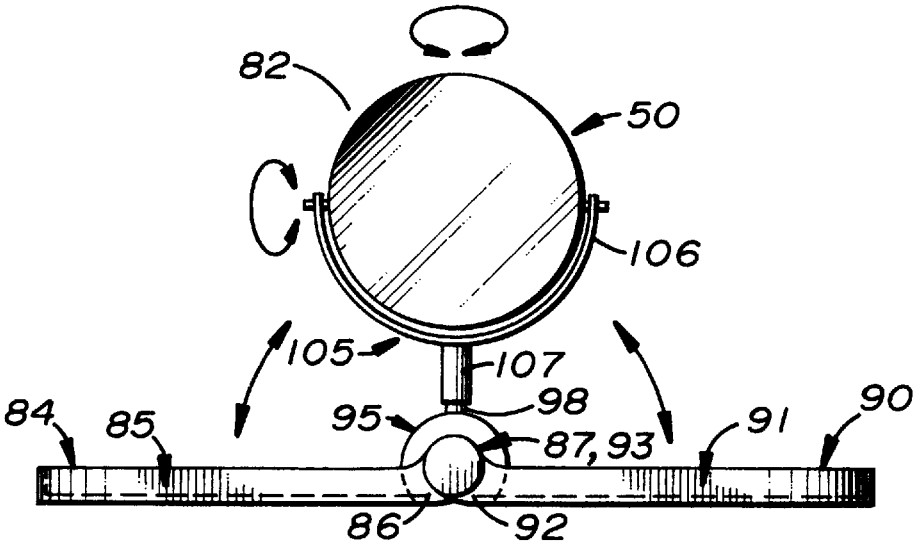
FIG. 7 is a side elevational view of another embodiment of the compact case.
Figure 9:
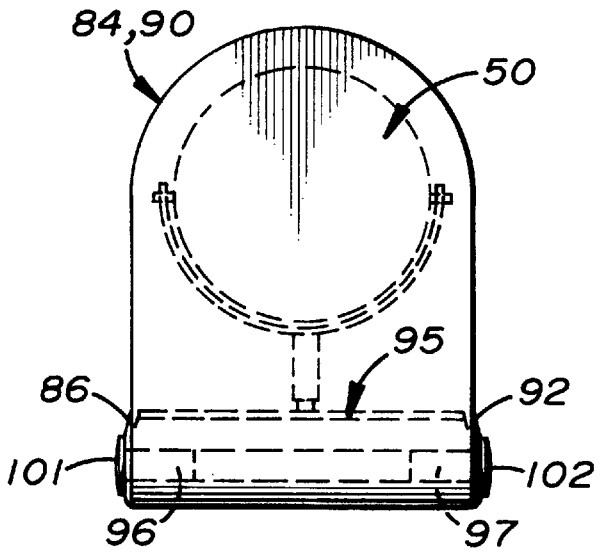
FIG. 9 is a front plan view of the compact case show in FIG. 8.
Figure 8:
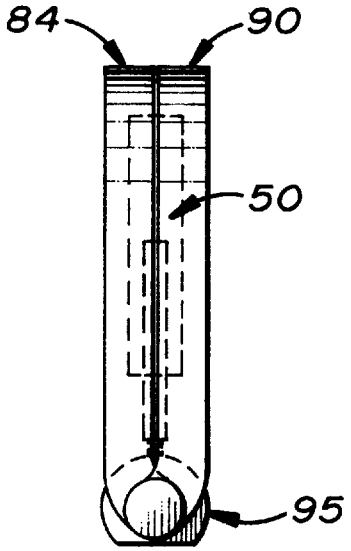
FIG. 8 is a side elevational view of the compact case shown in FIG. 7 with the two lids closed around the mirror.

FIGS. 7–9 disclose a second embodiment of the compact case, generally denoted by the reference number 82, with a pair of first and second lids, 84 and 90, respectively, that close around the mirror assembly 50. The first and second lids, 84 and 90, respectively, are pivotally connected to a cylindrical-shaped hinge assembly 95. Each lid 84 and 90 includes a pair of ears 86 and 92 that extend longitudinally from the main body of each lid 84, 90. The inside, central portion of each lid 84, 90 is removed, thereby forming a cavity, 85, 91, respectively, therein. Bores 87, 93 are formed on each ear 86, 92, respectively. The hinge assembly 95 also has two bores 96, 97, formed at its opposite ends designed to receive caps 101, 102, respectively. During assembly, the lids 84, 90 are positioned around the hinge assembly 95 so that the bores 87, 93 are aligned with bores 96 and 97. Caps 101 and 102 are then inserted through the bores 84, 87 and 90, 93, respectively to pivotally connect the lids 84, 90 to the hinge assembly 95. Formed centrally on the hinge assembly is a post 98 perpendicularly aligned to the hinge assembly's longitudinal axis.

The mirror assembly 50 is attached to a Y-shaped yoke 105 having a U-shaped frame 106 and a stem 107. During assembly, the mirror assembly 50 having both normal and enlarging reflective surfaces 52, 54 is attached to the U-shaped frame 106. An opening 108 is formed on the distal end of the stem 107 which connects to the post 98. The stem 107 is able to rotate 360° over the post 98.

During use, the compact case 82 is transported with the lids 84, 90 placed in a closed position around the mirror assembly 50. When placed in the closed position, the mirror assembly 50 and the stem 107 are rotated so that the reflective surfaces are substantially parallel to the lids 84, 90. When closed, the mirror assembly 50 is disposed inside the cavities 85 and 91. To open the compact case 82, the lids 84, 90 are rotated on the hinge assembly 95 to a desired angle of the support surface. The mirror assembly 105 may be rotated 360° on its x and y axis.

In compliance with the statute, the invention, described herein, has been described in language more or less specific as to structural features. It should be understood, however, the invention is not limited to the specific features shown, since the means and construction shown compromise only the preferred embodiments for putting the invention into effect. The invention is, therefore, claimed in any of its forms or modifications within the legitimate and valid scope of the amended claims, appropriately interpreted in accordance with the doctrine of equivalents.

We claim:

1. A mirror compact case, comprising:

a. a case having a longitudinally aligned cavity formed therein;

b. a longitudinally aligned yoke disposed inside said cavity in said case, said yoke capable of sliding longitudinally inside said cavity to retract or extend from said case; and c. a mirror assembly rotatably attached to said yoke, said mirror assembly having both normal and magnified reflective surfaces.

2. A mirror compact case, as recited in claim 1, further including a locking means enabling said yoke to be locked in a retracted position inside said case.

3. A mirror compact case, as recited in claim 1, further including a biasing means used to forcibly extend said yoke from longitudinal cavity in said case.

4. A mirror compact case, as recited in claim 1 further including an illumination means capable of illuminating said mirror assembly.

5. A mirror compact case, as recited in claim 1, wherein said magnified reflective surface has a magnification power of at least 1.5.

* * * * *